US005833544A

United States Patent [19]

Corbin et al.

[11] Patent Number: 5,833,544

[45] Date of Patent: Nov. 10, 1998

[54] FILM AND LIVE ACTION THEATER

[75] Inventors: Harry C. Corbin, Orlando, Fla.; Jim Crossley, New Windsor, N.Y.; Nicholas H. Drobnis, Universal City, Calif.; Fred Gallo, Jr., Poundridge; James M. Lehner, New Windsor, both of N.Y.; Harry E. Largman, Orlando, Fla.; John Leisner, Universal City, Calif.; Frank Masi, Los Angeles, Calif.; Edward S. Newquist, Glendale, Calif.

[73] Assignee: Universal Studios, Inc., Universal City, Calif.

[21] Appl. No.: 845,779

[22] Filed: Apr. 25, 1997

[51] Int. Cl.[6] ..... A63J 1/02

[52] U.S. Cl. ..... 472/79; 472/81; 472/83; 472/137; 472/57

[58] Field of Search ..... 472/57, 75, 77, 472/79, 81, 83, 137, 86

[56] References Cited

U.S. PATENT DOCUMENTS

| | | | |
|---|---|---|---|
| 1,093,943 | 4/1914 | McCormick . | |
| 1,123,066 | 12/1914 | Barber . | |
| 1,133,504 | 3/1915 | Reichenback . | |
| 1,154,787 | 9/1915 | McCormick . | |
| 1,186,451 | 6/1916 | Thomas . | |
| 1,324,630 | 12/1919 | Thurston . | |
| 3,084,933 | 4/1963 | Alswang | 272/10 |
| 3,442,508 | 5/1969 | Rudas | 272/21 |
| 3,625,510 | 12/1971 | Szigety | 272/21 |
| 3,754,756 | 8/1973 | Szigety | 272/21 |
| 5,486,141 | 1/1996 | Ohga et al. | 472/60 |

*Primary Examiner*—Christopher Kent
*Assistant Examiner*—Yvonne Horton-Richardson
*Attorney, Agent, or Firm*—Lyon & Lyon LLP

[57] ABSTRACT

A film to live-action theater includes a screen facing an audience seating area. The screen has exit and entrance openings and movable panels to open and close off the openings. A screen elevator lifts the screen from a lowered position, wherein the entrance and exit openings are concealed behind a stage, to an up position, to allow an actor and/or a prop to move through the openings. The audience views a film presentation projected onto the lowered screen. At a predetermined time, the screen is quickly raised and a live actor and/or a prop move through the screen to a front stage area, on a track. The opening of the door panels is preferably partially concealed through special effects such as fog or lighting. As the film presentation is preferably made with three dimensional film technology, the audience perceives a film-to-live transition.

26 Claims, 6 Drawing Sheets

FILM AND LIVE ACTION THEATER

BACKGROUND OF THE INVENTION

The invention relates to amusement attractions or theaters that combine live-action theater and film presentations.

Amusement attractions having live-action shows, film presentations and special effects are well known. Generally, an audience seated in a theater watches a live-action show, which may involve actors, mechanical props, stunts and special effects, in combination with a film presentation. The film presentation itself may use special effects such as three dimensional images, and sound and vibration effects. These effects tend to enhance the perception of the audience that they are participating more in the on-screen action.

These types of theaters may include a simulated "film-to-live" transition in which an actor and/or a prop seems to materialize from a projected film image and onto a stage. In the past, film-to-live transitions have been achieved by having actors step through a slit opening in the screen. Other techniques have relied on screens made of elastic materials with multiple openings which are stretched open to allow actors to pass through and then snap closed. Various lighting effects, screens, and curtains have also been used. Of course, to make the transition appear realistic, i.e., that a character projected on the screen becomes live on stage, the transition must be smooth and properly timed and coordinated. Indeed, the transition itself should be unnoticeable, so that the audience is not distracted by it, to provide an enhanced theater experience.

SUMMARY OF THE INVENTION

To these ends, a theater includes a screen facing an audience seating area. A door in the screen is preferably opened and closed at predetermined times during the film presentation. A track advantageously extends from a back stage area behind the screen, through the door in the screen, to a front stage area. A prop, such as a vehicle, is movable along the track. In a preferred embodiment, at a predetermined time during the film presentation, the door in the screen opens and the prop passes through the door, creating the visual illusion of the action of the film presentation on the screen transforming into live action in front of the screen. The opening of the door, and the passage of the prop through the door may advantageously be partially concealed using special effects, such as a mist or fog generator. The prop preferably includes a motor to propel the prop along the track. In a preferred embodiment, the track extends from the door in the screen, around the front stage area, and then returns to the back stage area via a second door in the screen, with the track forming a closed loop.

The screen can preferably be raised and lowered, so that the door can be concealed from the audience, until the prop is ready to pass through the door. A show controller or computer is preferably linked to the film projector and to the actuators for raising and lowering the screen, and opening and closing the door, so that movement of the screen, door, and prop is coordinated and properly timed.

BRIEF DESCRIPTION OF THE DRAWINGS

Other objects and features of the invention will become apparent from the following detailed description taken in connection with the accompanying drawings which disclose one embodiment of the invention. It is to be understood, however, that the drawings are designed for the purpose of illustration only, and are not intended as a definition of the limits of the invention.

In the drawings, wherein similar referenced characters denote similar elements throughout the several views.

DETAILED DESCRIPTION OF THE PREFERRED EMBODIMENT

Figure 1:
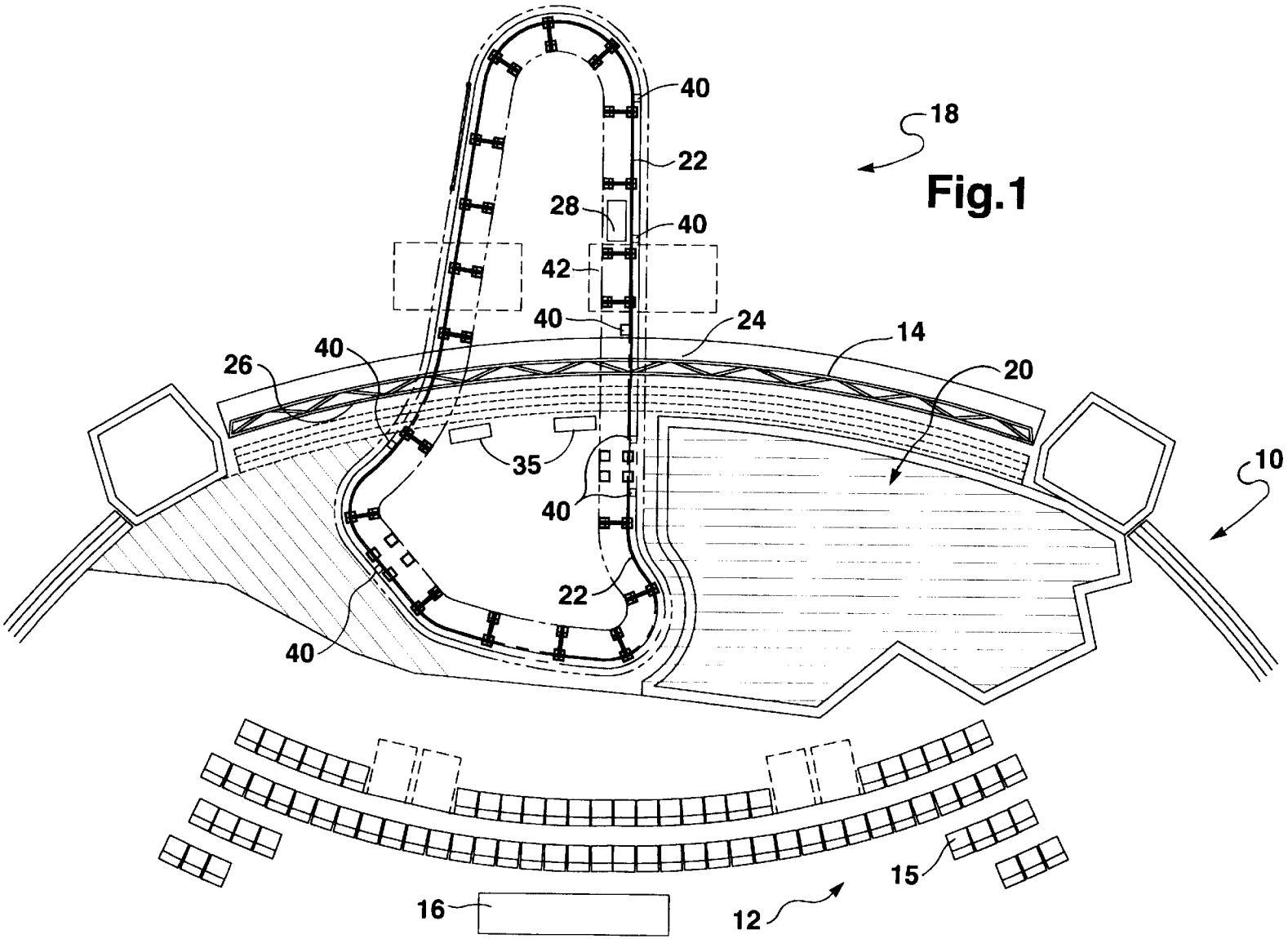
FIG. 1 is a plan view of the present theater.

Turning now in detail to the drawings, as shown in FIG. 1, a theater 10 has a seating area 12 having rows of seats 15. The seats face a screen 14. One or more projectors 16 towards the back of the theater 10 project images onto the screen 14. A back stage area 18 behind the screen 14, is not viewable from the seating area 12. A front stage area 20 is located in between the seating area 12 and the screen 14.

The screen 14 preferably includes a generally centrally located exit door opening 24 and an entrance door opening 26. A continuous loop track 22 extends through the exit door 24 and the screen 14, extends around the front stage area 20, and through the entrance door 26 to the back stage area 18.

Figure 2:
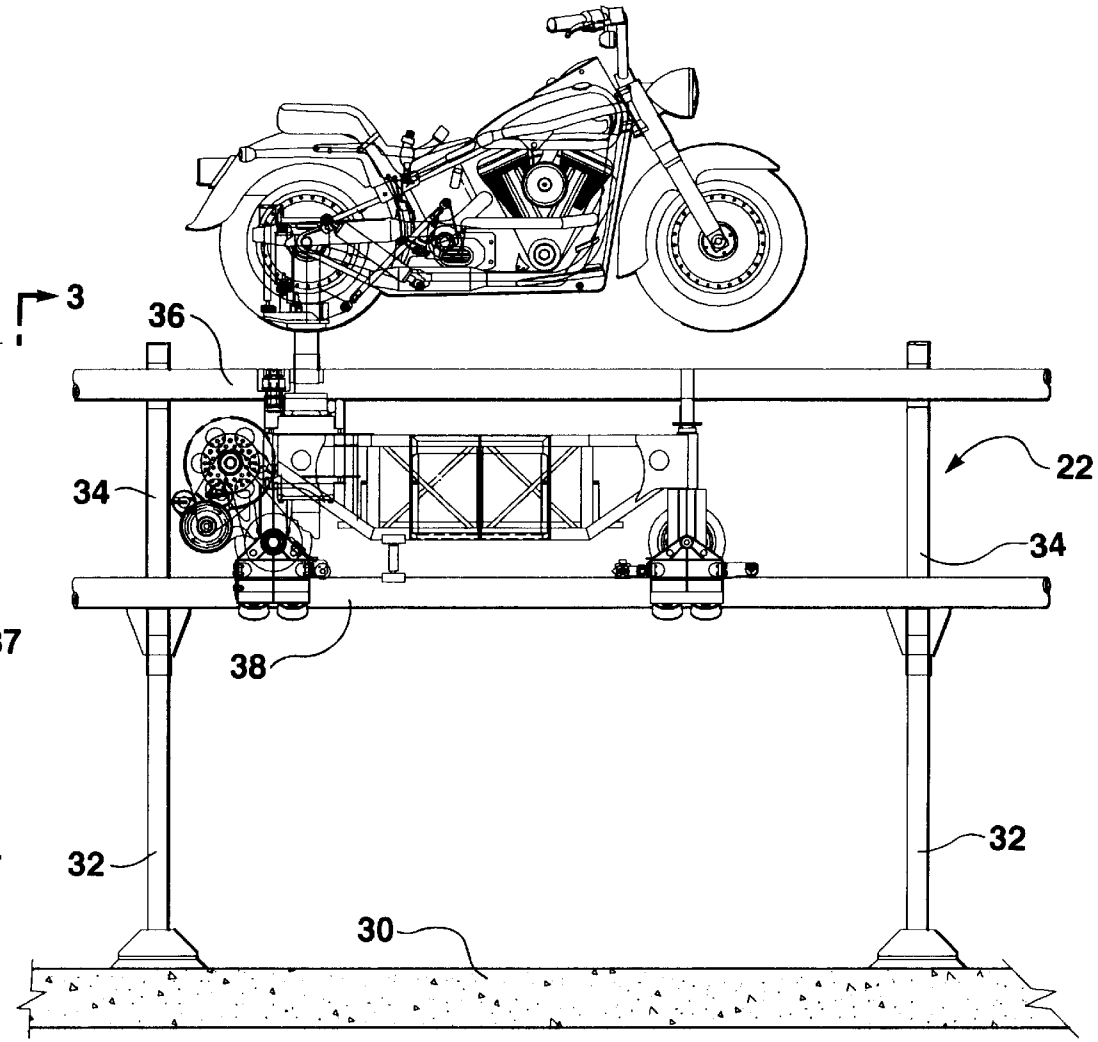
FIG. 2 is a side view showing the track of FIG. 1 and a mechanically animated prop.
Figure 3:
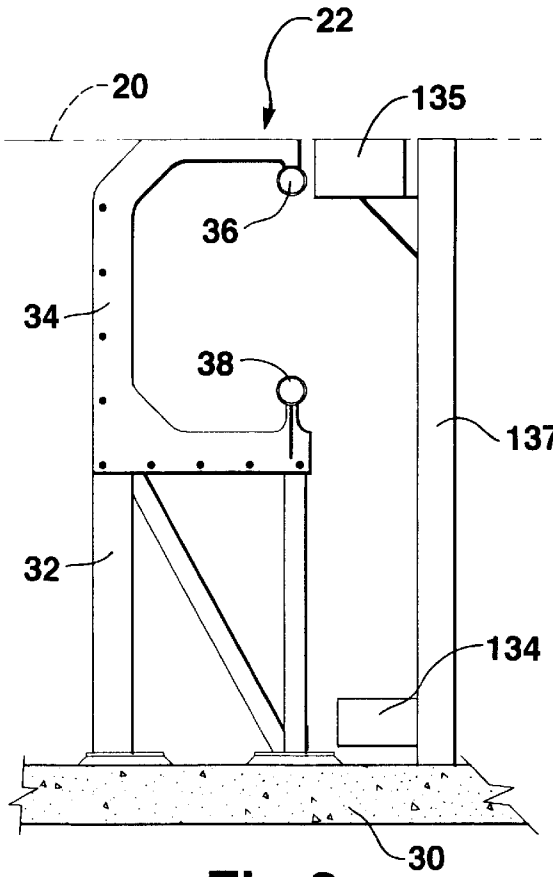
FIG. 3 is an end view taken along line 3—3 of FIG. 2.

Turning now to FIG. 2, the track 22 is supported above the theater floor or foundation 30 on structural posts 32. As shown in FIG. 3, the track 22 includes a C-frame 34 supporting a top rail 36 and a bottom rail 38.

Figure 4:
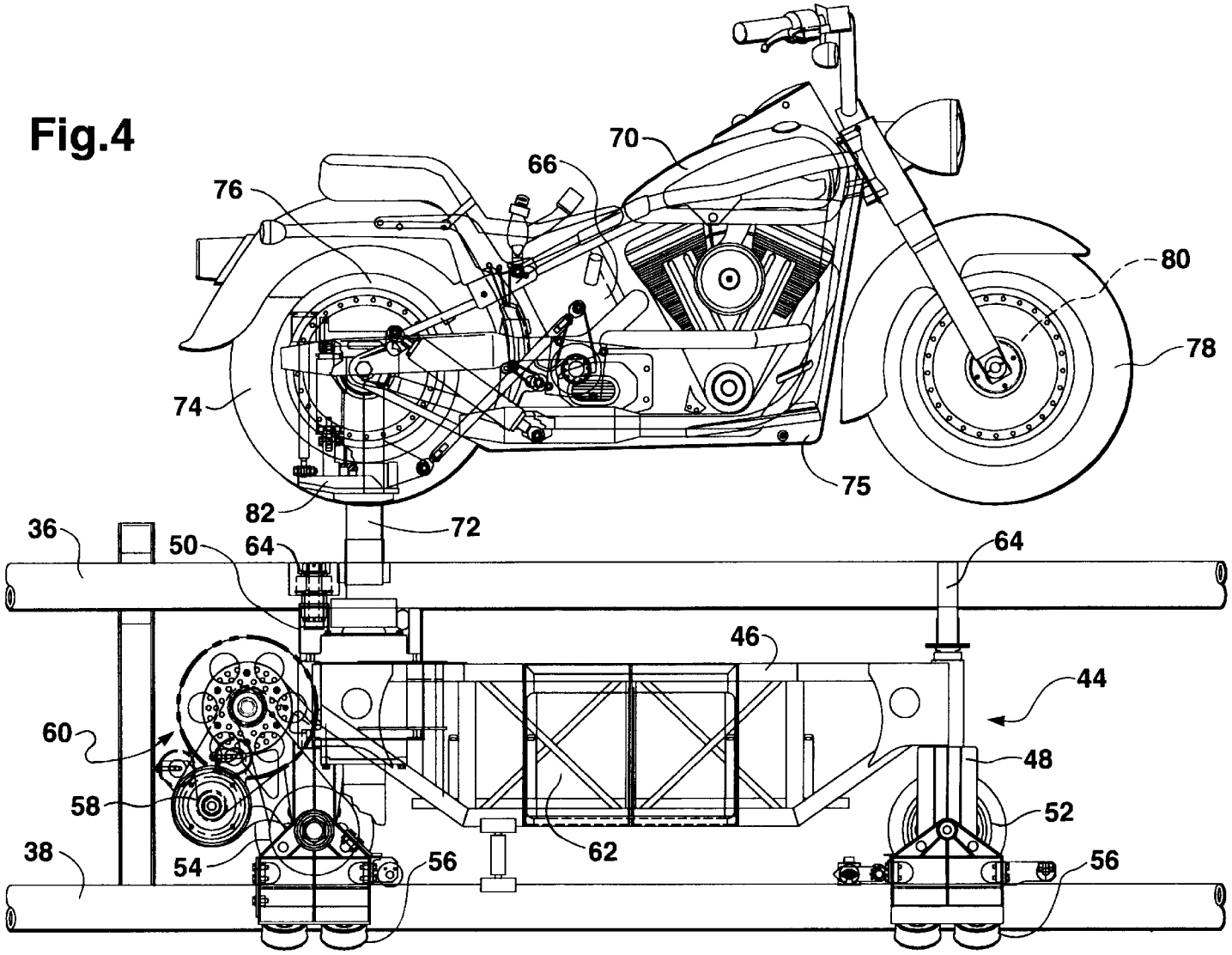
FIG. 4 is an enlarged side view showing the mechanically animated prop.
Figure 6:
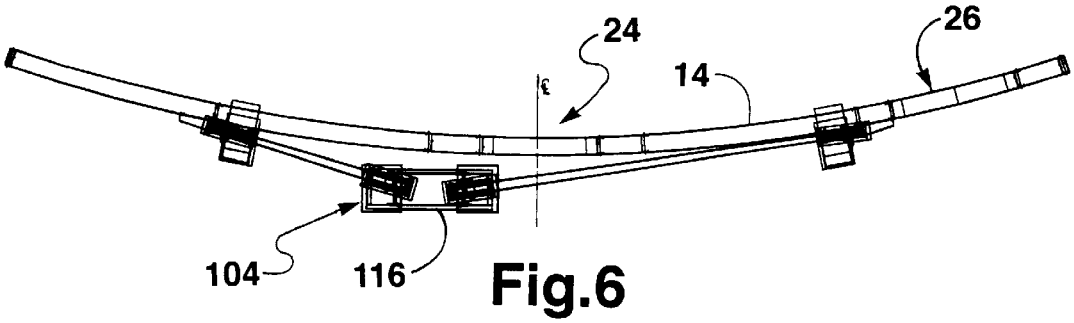
FIG. 6 is a top view thereof.

Referring to FIG. 4, a prop or vehicle carriage 44 has a front king pin 48 and a rear king pin 50 pivotably attached to a carriage frame 46. A front support wheel 52 and a rear support wheel 54 are rotatably mounted on the front and rear king pins 48 and 50. The support wheels 52 and 54 support the weight of the carriage 44 on the bottom rail 38 of the track 22. Opposing pairs of lower lateral tracking wheels 56 are spaced apart on opposite sides of the front and rear support wheels 52 and 54, and keep the support wheels centered on the bottom rail 38.

Referring still to FIG. 4, an electric motor 58 on the carriage 44 turns the rear support wheel 54 through a belt drive system 60. The motor 58 is powered by batteries 62 on the carriage 44. Alternatively, the motor 58 may be powered through a bus bar extending along side the track 22. Opposing pairs of upper tracking wheels 64 above the front and rear king pins 48 and 50 hold the carriage 44 in an upright vertical position as it moves along the track 22.

A prop, such as a motorcycle 70 is attached to an articulated arm 72 extending up from the carriage 44. The front wheel 78 is driven by a front electric motor 80 in the hub of the front wheel 78. The motorcycle 70 preferably has a rear scenic wheel 74 with left and right rear wheel disk facades. The facades are driven by a chain and a rear wheel electric motor 66 located in the space of the motorcycle transmission box. The facades create the appearance of a real motorcycle rear wheel on which the motorcycle rolls. As the carriage 44 and motorcycle 70 move along the track 22, it appears to ride on its wheels. The motors 66 and 80 are controlled to spin the rear wheel facades and the front wheel 80 in coordination with movement of the carriage 44 to create the appearance of a real motorcycle.

The carriage 44 includes actuators to move the motorcycle 70 in pitch ("wheelie"); lean ("roll"); and yaw ("turn"), so that as the motorcycle is propelled along the track via the electric motor 58 driving the rear support wheel 54, the motorcycle moves as a real motorcycle moves. The pitch, lean and yaw actuators are preferably DC servo electric linear actuators and standard DC servo actuators. Force counter-balance systems are used to reduce actual animation loads in the actuators. The actuators are concealed from view from the seating area 12.

The arm 72 is attached to the carriage 44 on bearing mounted pivots, to provide for the pitch, lean and yaw movements.

The front and rear support wheels 52 and 54, as well as the upper and lower lateral tracking wheels 56 and 64 are shaped and dimensioned to fit and ride on the top and bottom rails 36 and 38. The wheels are advantageously polyurethane. The arm 72 extends up from the carriage 44 through the middle stationary portion of the rear wheel, and connects to the motorcycle chassis 75, while concealed from view from the seating area 12 by the rear wheel disk facades.

A cam plate 82 extends outwardly from the motorcycle chassis 75, to activate a fail safe cam operated door opening system, as further described below.

Figure 5:
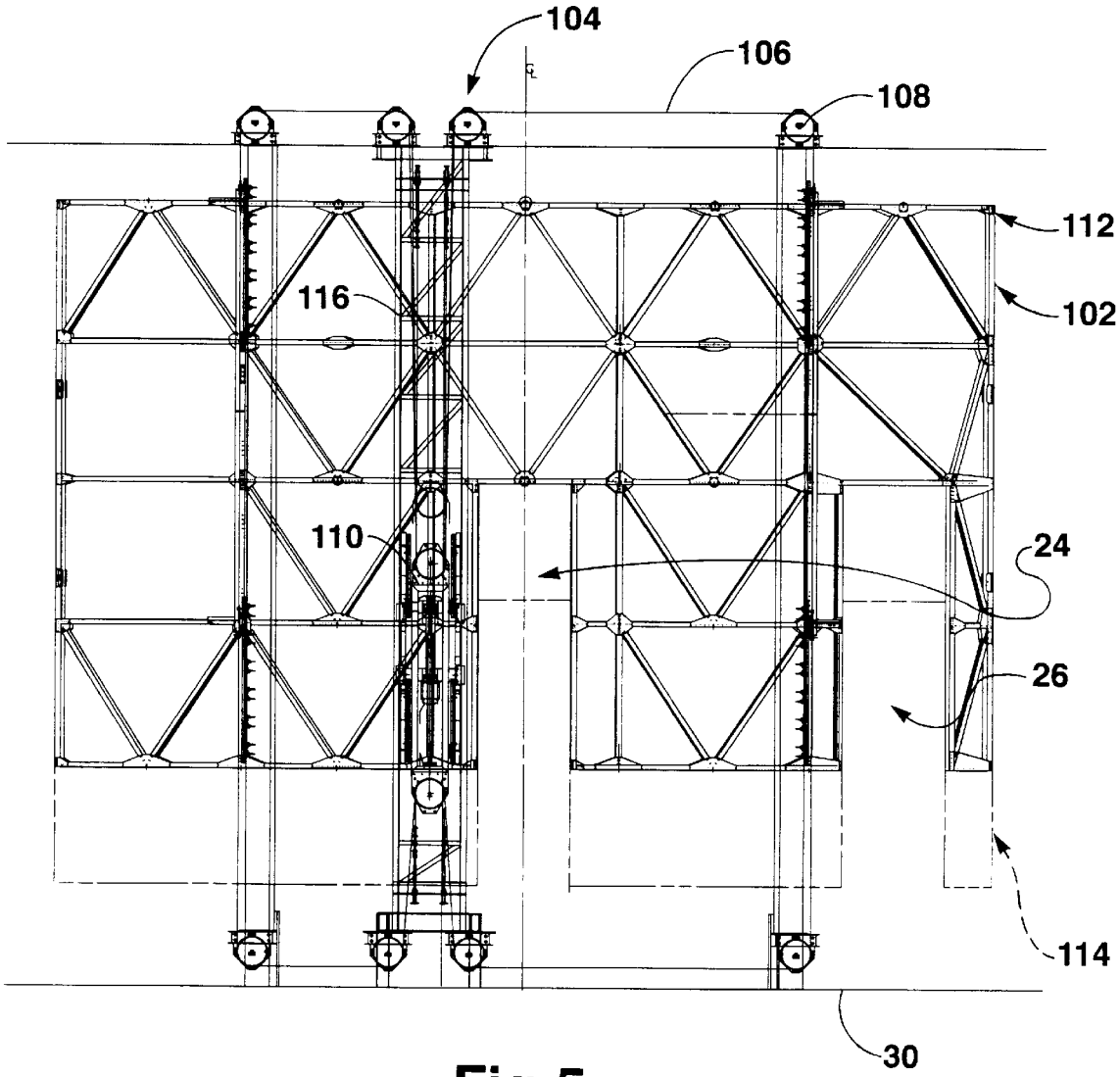
FIG. 5 is a rear view of the screen shown in FIG. 1.

Referring to FIG. 5, the screen 14 is supported on a screen structure 102 facing away from the seating area 12. A screen elevator 104 includes a system of wire ropes 106 and pulleys 108. A linear actuator 110 within a actuator column 116 is attached to the wire ropes 106. The actuator is controllable to quickly move the screen 14 between an up position 112 and a down position 114.

Figure 7:
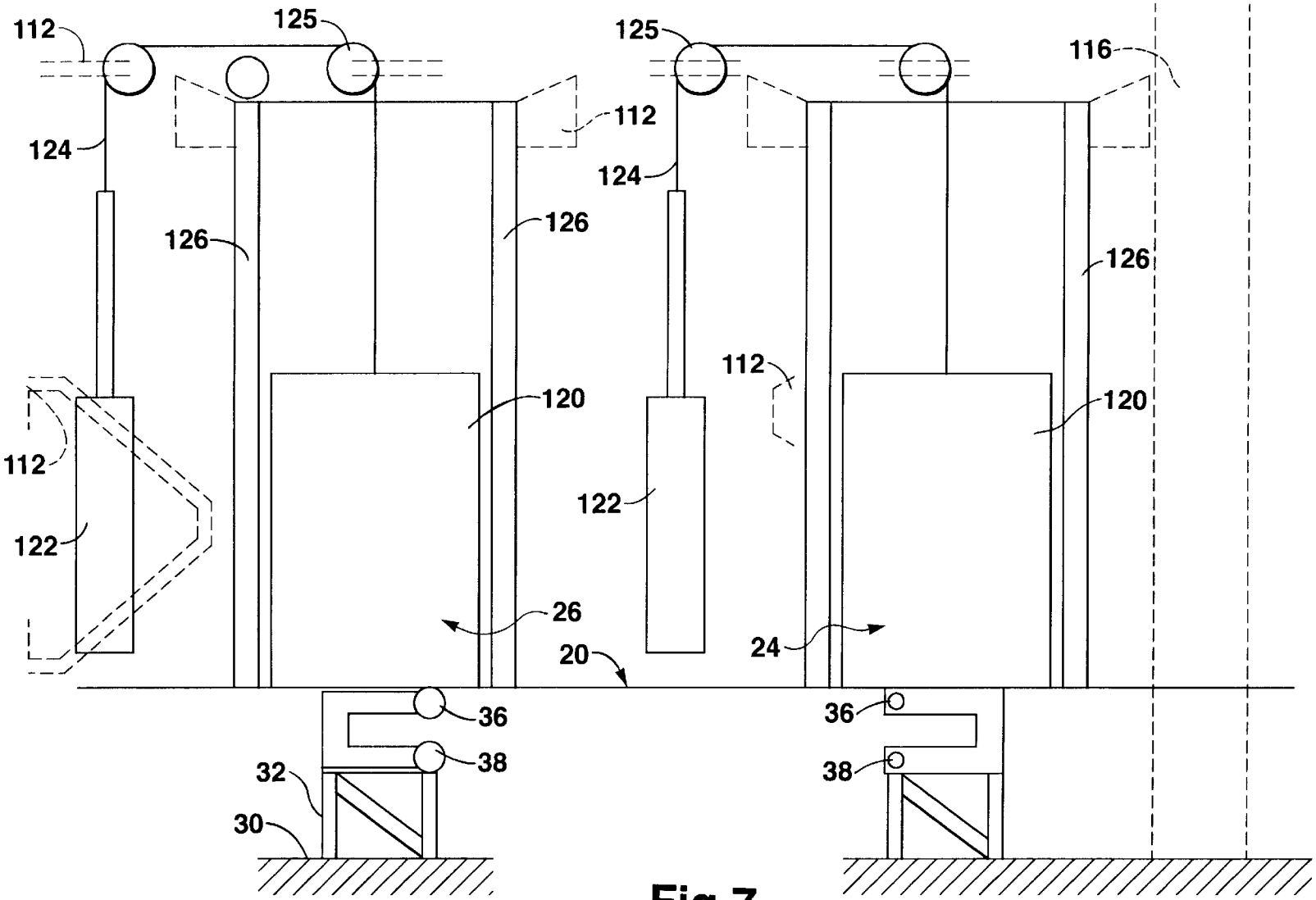
FIG. 7 is a front view looking through the screen.

Referring to FIG. 7, the exit opening 24 and the entrance opening 26 in the screen 14 are panel doors 120 vertically slidable along door track rails 126. The panels 120 are opened and closed by electric or pneumatic actuators 122 connected to the panels 120 via cables 124 extending around pulleys 125. The panels 120, actuators 122, pulleys 125 and door track rails 126 are all supported on and move up and down with the screen structure 102. The panels 120 are constructed with rigid frames and are covered with the same material as used for the screen 14.

The doors 24 and 26 are initially positioned below the level of the front stage 20. The screen 14 moves up to expose the doors 24 and 26. At a predetermined time during the film presentation, the doors open to allow a mechanical prop, such as the motorcycle 70 to enter and exit the stage.

Referring to FIG. 1, track sensors 40 are positioned at various locations along the track, to detect the position of the motorcycle 70 on the track. The sensors 40 are connected to a master controller 42 that controls the raising and lowering of the screen 14, and the actuators 122, to open and close the doors 24 and 26. The track sensors 40 are preferably magnetic field type sensors. When the motorcycle 70 passes the track sensors 40, the magnetic field is interrupted by an activator installed on the carriage 44. Various lighting or special effects are also controlled by the master controller 42 and may be initiated upon one or more of the track sensors 40 sensing the passing motorcycle.

Figure 8:
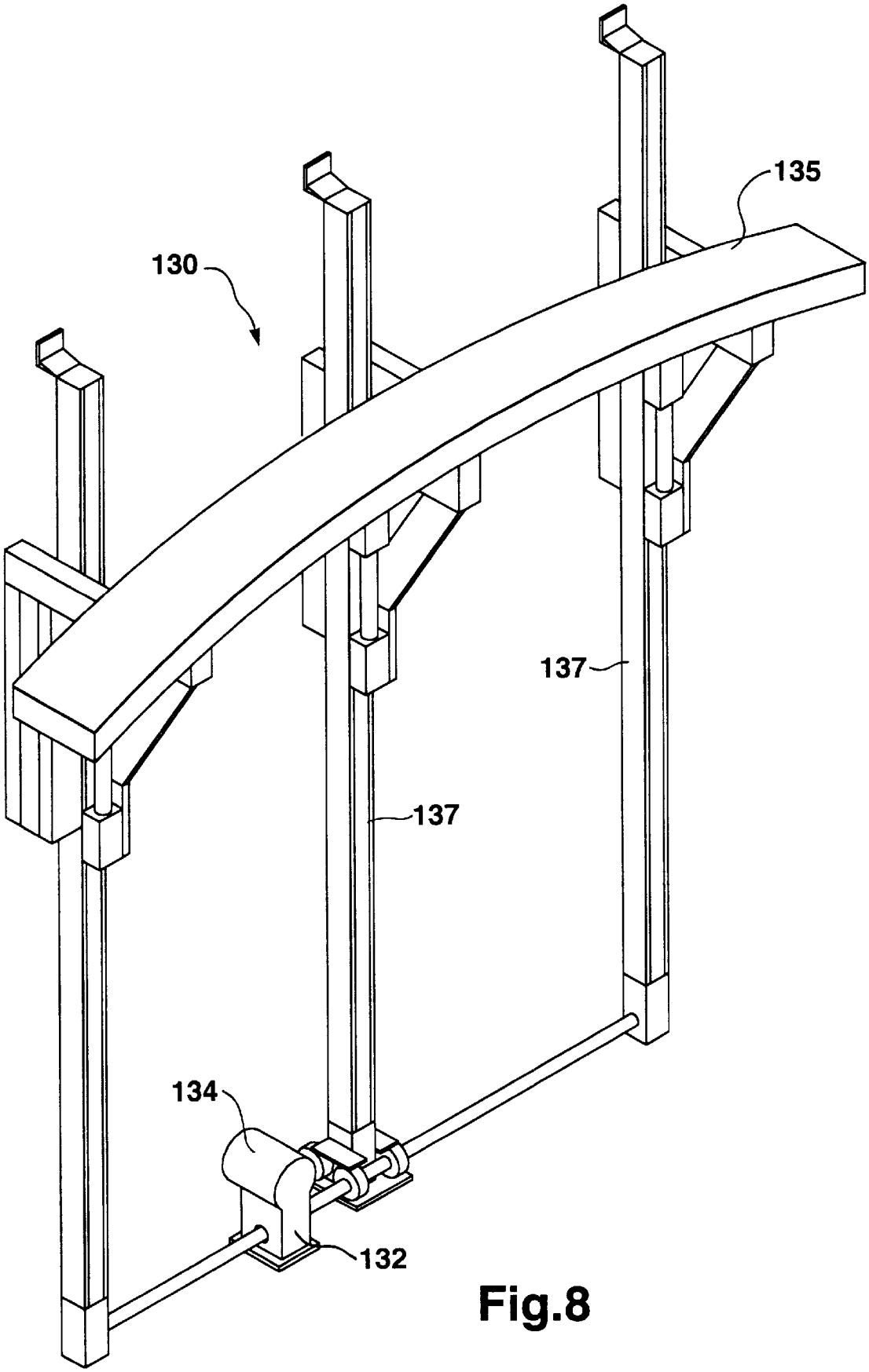
FIG. 8 is a perspective view of a track cover.

Referring now to FIG. 8, a track slot cover 130 made of multiple segments 135 is installed in the floor of the front stage 20 and covers the track 22 and track slot when it is not in use. Preferably, the track slot cover 130 is overlaid with the same material or carpeting as the front stage floor. In this manner, the track is virtually invisible to the audience. During the show, the track slot cover 130 lowers out of the way, via jackscrews 137, a gearbox 132 and motor 134, thereby clearing a channel through which the motorcycle 70 and carriage 44 may pass. After the motorcycle 70 and carriage 44 have passed through the portion of the track covered by each track slot cover segment 135, that segment of the track slot cover 130 is raised to again conceal the track from the audience in the seating area. Alternatively, the segments may all move simultaneously.

Multiple segments 135 of track slot cover 130 are provided on the front stage 20, to cover all parts of the track 22 ordinarily viewable from the seating area 12. The segments of track cover may be operated sequentially, dropping down in front of the approaching motorcycle and raising up right after the motorcycle has passed, or they may operate simultaneously, with all segments moving up and down together. The cover segment shown in FIG. 8 is preferably about 7 feet long. The number of cover segments used will vary with the total length of the track 22 in the front stage 20.

During the actual show, the audience is seated in the audience seating area 12. Live actors begin a live-action theater portion of the show on the front stage 20. Various special effects, such as fog, audio effects or special lighting may be used in the theater 10 during the live-action portion of the show. At a predetermined time during the live-action portion, the film presentation begins. The film presentation is preferably in 3-D and, as is known in the art, the audience is given special glasses to wear in order to experience the 3-D film effect. Two projectors 16 project the 3-D film onto the screen 14.

Preferably, in a particular sequence of the film presentation, an actor is riding a motorcycle.

Of course, any type of vehicle or other prop could be used in the film sequence in place of the motorcycle. As the actor and motorcycle ride in the film toward the plane of the screen, the live motorcycle and rider are stationed behind the projection screen 14 on the backstage 18 on a staging platform 28, primed for the film-to-live transition.

Timed with the film sequencing and activated by one of the track sensors 40, the projection screen 14 is raised up by the screen elevator 104. At this point, the live motorcycle 70 and rider are launched toward the exit door 24 in the projection screen 14, by accelerating the carriage 44 using the motor 66. The master controller causes the actuator 122 to open the panels 120 of the door 24. The door 24 opens just long enough for the motorcycle and rider to transition onto the front stage 20. This transition takes place at the exact time the film sequence ends. This time is sensed by the master controller through a link to the projectors. Fog effect generators 35 just in front of the screen help the mask the entrance of the motorcycle and rider onto the front stage 20 through the door 24.

Once the live motorcycle and rider enter the stage, the door 24 closes and the projection screen moves down to its normal position. The physical transition takes place in less than 4 seconds. In the preferred embodiment, the screen moves up or down about 7 feet in about 1 second. The door panels 120 open or close (to make an about 7 foot opening) in about ½ second. The audience perceives a film-to-live transition.

After the transition, the motorcycle and rider continue to travel around the front stage 20 on the track 22. Other live actors preferably continue with the live-action show. Each segment of the track slot cover 130 is lowered out of the way to allow the motorcycle and rider to pass through and then is raised to conceal the track once again. Alternatively, all of the segments are lowered at the same time as the motorcycle approaches, and are raised back up simultaneously after the motorcycle leaves the front stage.

As the carriage 44 and motorcycle 70 move across the front stage 20, the motorcycle 70 accelerates slows, power turns (fishtail) and then accelerates. The track 22 on the front stage 20 has several changes in elevation which appear as stairs, drops, etc. The elevation axis actuator on the carriage 44 elevates the motorcycle 70 about a horizontal axis extending through the rear wheel 74, causing the motorcycle to "pop a wheelie". At the same time, the rear wheel facades accelerate, to simulate a rear tire "burn out" during wheelie or fishtail motorcycle movements.

As the motorcycle approaches the entrance door 26, the motorcycle and rider prepare to make a live-to-film transition. The projection screen is again raised up by the elevator 104. The motorcycle and rider travel up a ramp towards the projection screen. The entrance door opens and the motorcycle and rider pass through the screen. Simultaneously, the film presentation continues with an actor on the motorcycle appearing on the projection screen 14. The audience perceives a live-to-film transition. Special fog effects advantageously help to mask the exit of the live motorcycle and rider from the stage through the door 24. Once the live motorcycle and rider are backstage, the entrance door closes and the screen is lowered to its normal position. The live-to-film transition also takes place in less than 4 seconds. Backstage, the motorcycle stops at the staging platform and is reset for the next show.

The movement of the carriage 44 and motorcycle 70, the exit door 24 and entrance door 26 and the screen 14 are advantageously all timed and controlled by the master controller. As a back up system, mechanical override door opening systems are provided at the exit door 24 and entrance 26, and are actuated by the cam plate 82 on the motorcycle 70. In the event of a controller or electrical failure, the screen elevator 104 automatically lifts the screen 14 to the up position. The mechanical movement of the cam plate engaging the mechanical door opening systems then opens the doors in the screen 14.

While the invention is susceptible to various modifications and alternative forms, specific examples have been shown in the drawings and are described in detail. It should be understood, however, that the invention is not limited to the particular forms or methods disclosed. Rather, the invention is intended to cover all modifications, equivalents and alternatives falling within the spirit and scope of the claims.

We claim:

1. A theater comprising:

an audience seating area;

a screen facing the audience seating area;

a first door in the screen;

means for opening and closing the door;

a track extending through the door; and a prop moveable along the track.

2. The theater of claim 1 further comprising a motor on the prop for propelling the prop along the track.

3. The theater of claim 1 wherein the prop comprises a vehicle.

4. The theater of claim 1 wherein the track comprises a continuous loop.

5. The theater of claim 1 further comprising a front stage area between the audience seating area and the screen, with the track extending from the first door to a second door in the screen through the front stage area.

6. The theater of claim 4 further comprising a front stage area between the audience viewing area and the screen, and a back stage area substantially separated from the front stage area by the screen, and the loop has a front section in the front stage area and a back section in the back stage area.

7. The theater of claim 1 further comprising at least one projector spaced apart from the screen by the audience seating area.

8. The theater of claim 1 further comprising seats in the seating area.

9. The theater of claim 8 further comprising a controller linked to the projector and to the means for opening and closing the door.

10. The theater of claim 2 further comprising a bus bar along the track for powering the motor.

11. The theater of claim 2 further comprising batteries on the prop for powering the motor.

12. The theater of claim 1 further comprising a special effects generator adjacent to the door.

13. A method of simulating a film-to-live transition, comprising the steps of:

positioning a prop on a track extending out of a projection screen;

projecting a film presentation onto the projection screen;

raising the projection screen to a predetermined level at a first predetermined time during the film presentation;

opening a hidden door in the projection screen at a second predetermined time during the film presentation;

driving the prop on the track through the opened door in the projection screen;

closing the door in the projection screen; and lowering the projection screen to its initial position once the prop has cleared the plane of the projection screen.

14. The method of simulating a film-to-live transition in an amusement attraction of claim 13, whereby the step of projecting a film presentation on the projection screen further comprises projecting a three dimensional film presentation on the projection screen.

15. A theater comprising:

an audience seating area;

a screen facing the audience seating area;

a first door in the screen;

means for opening and closing the first door;

a track extending through the first door;

a second door in the screen with the track extending through the second door; and a prop movable along the track.

16. The theater of claim 15 wherein the track comprises a continuous loop.

17. The theater of claim 15 further comprising a front stage area between the audience seating area and the screen, with the track extending from the first door to the second door through the front stage area.

18. A theater comprising:

an audience seating area;

a screen facing the audience seating area;

a door in the screen;

an actuator linked to the door for opening and closing the door;

a track extending through the door;

a prop movable along the track; and means for raising and lowering the screen, so that the door can be concealed from the audience viewing area when the screen is lowered.

19. The theater of claim 18 wherein the means for raising and lowering includes a linear actuator.

20. A theater comprising:

an audience seating area;

a screen facing the audience seating area;

a door in the screen;

an actuator attached to the screen and to the door for opening and closing the door;

a track extending through the door; and a prop movable along the track.

21. The theater of claim 20 further comprising means for raising and lowering the screen, so that the door can be concealed from the audience viewing area when the screen is lowered.

22. The theater of claim 20 further comprising vertically oriented door track rails on the screen, on either side of the door.

23. The theater of claim 20 further comprising a track slot cover adjacent to the track.

24. The theater of claim 20 further comprising fog generators adjacent to the door between the screen and the audience seating area.

25. A theater comprising:

a screen;

a door in the screen;

means for opening and closing the door; and means for moving the screen, to move the door between concealed and exposed positions.

26. The theater of claim 25 wherein the means for moving comprises a linear actuator for moving the screen vertically.

* * * * *